US008596282B2

(12) United States Patent
Kawata et al.

(10) Patent No.: US 8,596,282 B2
(45) Date of Patent: Dec. 3, 2013

(54) ORAL TOBACCO PRODUCT

(75) Inventors: Norio Kawata, Tokyo (JP); Manabu Takeuchi, Tokyo (JP); Manabu Yamada, Tokyo (JP)

(73) Assignee: Japan Tabacco Inc., Tokyo (JP)

( * ) Notice: Subject to any disclaimer, the term of this patent is extended or adjusted under 35 U.S.C. 154(b) by 0 days.

(21) Appl. No.: 13/566,337

(22) Filed: Aug. 3, 2012

(65) Prior Publication Data

US 2012/0291794 A1 Nov. 22, 2012

Related U.S. Application Data

(63) Continuation of application No. PCT/JP2011/050441, filed on Jan. 13, 2011.

(30) Foreign Application Priority Data

Feb. 5, 2010 (JP) ..... 2010-024092

(51) Int. Cl.
*A24B 15/00* (2006.01)

(52) U.S. Cl.
USPC ..... 131/352

(58) Field of Classification Search
USPC ..... 131/352
See application file for complete search history.

(56) References Cited

U.S. PATENT DOCUMENTS 2,086,169 A * 7/1937 Molins et al. ..... 206/268
2,179,953 A * 11/1939 Pitman ..... 131/365
4,867,179 A * 9/1989 Leonard ..... 131/96
5,033,484 A * 7/1991 Seidel et al. ..... 131/364
7,950,399 B2 5/2011 Winterson et al.
7,980,251 B2 7/2011 Winterson et al.
2007/0012328 A1 1/2007 Winterson et al.
2008/0029116 A1 2/2008 Robinson et al.
2011/0203601 A1 8/2011 Winterson et al.
2011/0240048 A1 10/2011 Winterson et al.

FOREIGN PATENT DOCUMENTS

CN 101222661 A 7/2008
JP 2008-538911 A 11/2008
JP 2009-529342 A 8/2009
WO 2006/120570 A2 11/2006
WO 2007/104573 A2 9/2007
WO 2008/135469 A1 11/2008

OTHER PUBLICATIONS

International Search Report issued in PCT/JP2011/050441 dated Apr. 19, 2011.
Written Opinion issued in PCT/JP2011/050441 dated Apr. 19, 2011.
Office Action for corresponding Taiwanese Patent Application No. 100102236, dated Jan. 22, 2013.

* cited by examiner

*Primary Examiner* — Richard Crispino
*Assistant Examiner* — Dionne Walls Mayes
(74) *Attorney, Agent, or Firm* — Birch, Stewart, Kolasch & Birch, LLP

(57) ABSTRACT

An oral tobacco product (1) has a pouch (2) made of a non-woven fabric, a tobacco mixture containing tobacco particles made from tobacco materials as a major ingredient, enclosed in the pouch (2), and a water-repellent area (30) formed on an inner surface of the pouch (2) to account for 50% of the entire inner surface of the pouch, the water-repellent area preventing permeation of water.

14 Claims, 8 Drawing Sheets

ORAL TOBACCO PRODUCT

This application is the Bypass Continuation of the International Application No. PCT/JP2011/050441, filed on Jan. 13, 2011, which claims priority to Patent Application No. 2010-024092, filed in Japan on Feb. 5, 2010. The entirety of the above-identified applications are expressly incorporated herein by reference.

TECHNICAL FIELD

This invention relates to an oral tobacco product with which the user absorbs active constituents of tobacco via saliva.

BACKGROUND ART

Cigarettes have long been enjoyed as recreational goods. In recent years, however, smokeless tobacco, usable anywhere, has been attracting attention. Use of such smokeless tobacco is permitted even in places where smoking is prohibited, including airplane cabins and train compartments.

Snus is known as an oral tobacco product belonging to the class of smokeless tobacco. Snus contains, as a major ingredient, shreds obtained by finely shredding tobacco materials, and those tobacco shreds have a high moisture content.

Specifically, snus is classified into a loose type, which is non-packaged tobacco shreds, and a portion type called also a pouch type, which is tobacco shreds packaged with non-woven fabric or other material.

The pouch-type snus is designed such that the user puts it directly in the mouth and holds it between the upper lip and gum to be able to enjoy the aroma of tobacco shreds and take tobacco active constituents, extracted from tobacco shreds into saliva, into the body through the gum.

Pouch-type snus with a water-soluble film covering the inner surface of the pouch is also known. Snus of this type is designed such that after the user puts it in the mouth, the film dissolves in saliva to allow tobacco active constituents to be extracted from tobacco shreds into saliva (patent document 1).

PRIOR-ART DOCUMENT

Patent Document

Patent document 1: Japanese Translation of International Application Laid-open No. 2008-538911

SUMMARY OF THE INVENTION

Problem to be Solved by the Invention

Snus disclosed in patent document 1 includes tobacco shreds having a relatively low moisture content. This is because tobacco shreds having a high moisture content cause the water-soluble film to break down due to moisture in the tobacco shreds, prior to the user's use of snus. Thus, in the case of snus of patent document 1, it is after the user puts the snus in the mouth and the water-soluble film dissolves that the user can ingest tobacco active constituents from tobacco shreds via saliva. This means that there is a time lag between the user's putting the snus in the mouth and the ingestion of tobacco active constituents.

By contrast, pouch-type snus not having a water-soluble film and including tobacco shreds having a high moisture content allows the user to ingest tobacco active constituents via saliva immediately after putting it in the mouth, and thus, gives the user a great sense of satisfaction, compared with the snus of patent document 1.

However, when the tobacco shreds have a high moisture content, tobacco active constituents are likely to spread to every part of the outer surface of the pouch, together with water, during storage of the snus. The tobacco active constituents permeating the pouch-forming nonwoven fabric changes the color thereof, and thus, makes the snus appear dirty. Such snus not only gives the user an unpleasant feeling but also soils the surroundings with the tobacco active constituents penetrating through the pouch.

An object of the present invention is to provide an oral tobacco product which can suppress the spreading of tobacco active constituents to the outer surface of the pouch and keep good appearance during storage.

Means for Solving the Problem

In order to achieve the above object, the present invention provides an oral tobacco product comprising a tobacco mixture containing tobacco particles made from tobacco materials as a major ingredient; a pouch made from a wrapper to enclose the tobacco mixture, the wrapper being water-permeable; and a water-repellent area formed on at least either an outer or an inner surface of the pouch to account for 20 to 60% of the entire outer or inner surface of the pouch, the water-repellent area preventing permeation of water.

When the oral tobacco product according to the present invention is put in the user's mouth for use, saliva containing water moves between the interior of the mouth and the interior of the pouch via the area of the pouch other than the water-repellent area. This allows tobacco active constituents to be extracted from the tobacco particles into saliva, so that the user can absorb the tobacco active constituents into the body via saliva.

During storage, the oral tobacco product according to the present invention can suppress seeping of the water containing tobacco active constituents from the pouch by virtue of the water-repellent area formed on the pouch, even though the tobacco particles have a high moisture content. The possibility that the tobacco product is seriously spoiled in appearance during storage is therefore low. The possibility that the tobacco products soil each other is also low, even though they are stored contacting each other.

The water-repellent area is formed not all over the outer or inner surface of the pouch, but formed to account for 20 to 60% thereof. This ensures that saliva satisfactorily moves via the area of the pouch other than the water-repellent area, and thus, that the user can satisfactorily absorb the tobacco active constituents.

Desirably, the water-repellent area accounts for 40 to 50% of the entire outer or inner surface of the pouch. Specifically, the water-repellent area may be formed by applying a water-repellent material chosen from a group consisting of fluorine-based resin, paraffin resin, silicon-based resin and epoxy resin.

The water-repellent material may contain an additive for making the water-repellent area appear in the same color as the wrapper. This keeps the water-repellent area on the outer or inner surface of the pouch unnoticeable during storage of the oral tobacco product.

Desirably, the tobacco particles have a pH between 6.5 and 9.5 and a moisture content between 15 and 50 weight %.

Effect of the Invention

The oral tobacco product according to the present invention can suppress seeping of tobacco active constituents, thereby keeping good appearance during storage, and allow the user to satisfactorily absorb the tobacco active constituents in use.

MODE OF CARRYING OUT THE INVENTION

Figure 1:
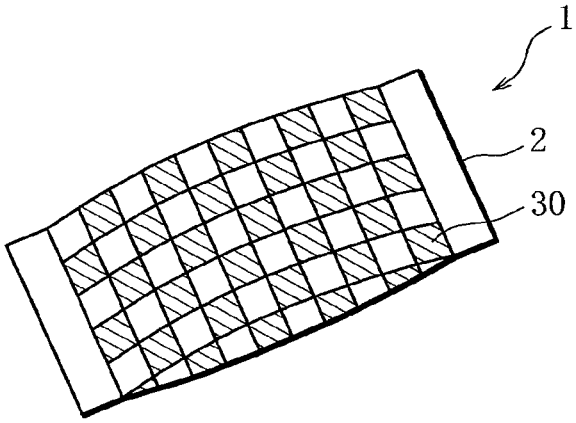
FIG. 1 is a schematic diagram showing a first embodiment of oral tobacco product according to the present invention.

As seen in FIG. 1, an oral tobacco product 1 (hereinafter referred to simply as "tobacco product 1") comprises a pouch 2 and a tobacco mixture enclosed in the pouch 2. The pouch 2 is formed from a sheet of water-permeable nonwoven fabric. The tobacco mixture contains tobacco particles as a major ingredient. Specifically, the tobacco particles are obtained by shredding or crushing tobacco materials, and measure 2 mm or less in particle diameter.

Figure 2:
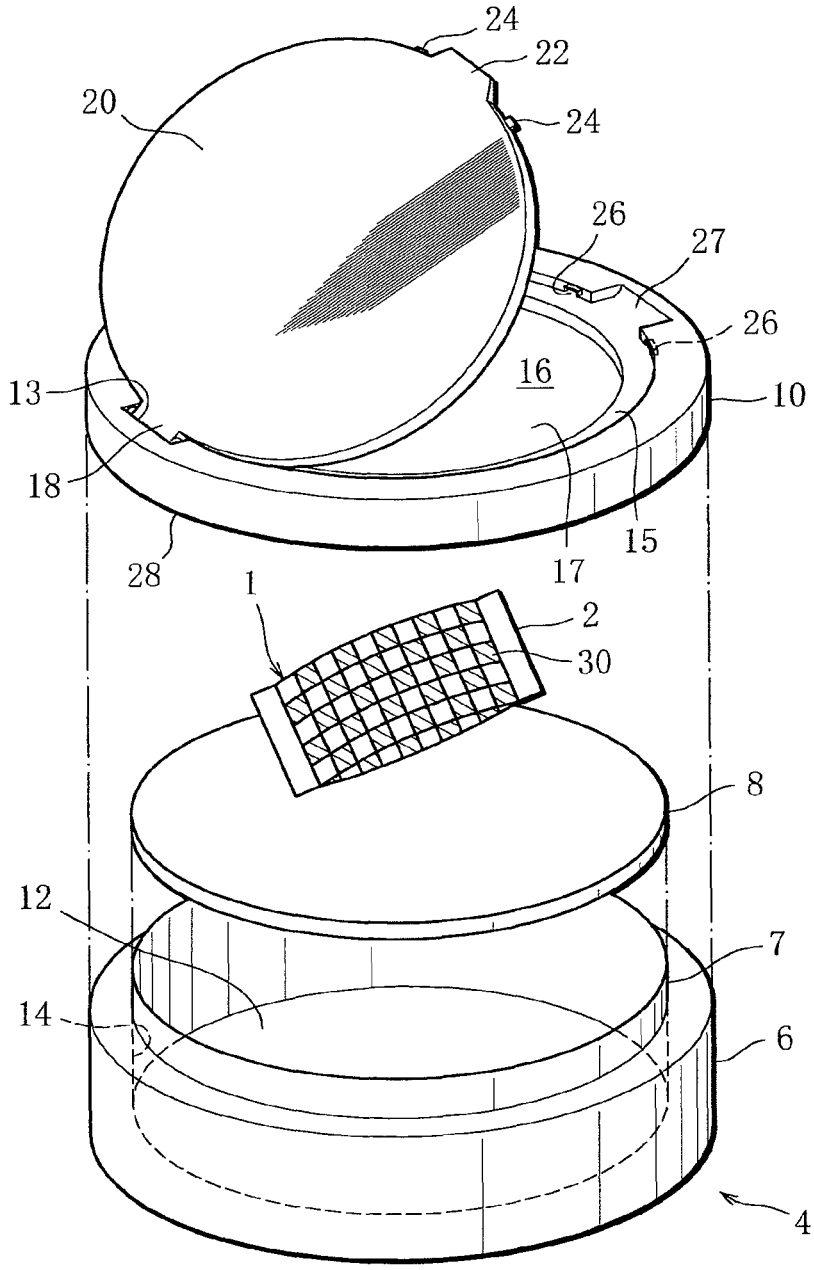
FIG. 2 is an exploded perspective view showing a container case in which to keep the tobacco product shown in FIG. 1.

Such tobacco products 1 are kept in a container case 4 shown in FIG. 2, for example. The container case 4 includes a case body 6, a mat 8 and a lid 10. The case body 6 is in the form of a flat cylinder with an open top portion 7. The open top portion 7 is an upward-projecting circular portion and openably closed with the lid 10.

The mat 8 is circular in shape and has an outside diameter approximately equal to the inside diameter of the case body 6. The mat 8 is placed on the bottom 12 of the case body 6. Thus, inside the container case 4, tobacco products 1 are stacked over the mat 8.

The lid 10 is circular in shape and has an outside diameter equal to the outside diameter of the case body 6. The lid 10 has an approximately-circular stepped hollow 16 in the top. The stepped hollow 16 has a bottom 17 and an annular rest surface 15 around the bottom 17. The depth up to the rest surface 15 is smaller than the depth up to the bottom 17. An annular raised portion surrounding the rest surface 15 has a notch 13, and a circular cover 20 is joined by a hinge 18 in the notch 13. The cover 20 has an outside diameter approximately equal to the outside diameter of the rest surface 15. The cover 20 can thus be fitted in the hollow 16 to cover the hollow 16 with its periphery edge in close contact with the rest surface 15. From this closed position, the cover 20 can be turned upward on the hinge 18 to expose the hollow 16. The cover 20 can thus openably close the hollow 16. With the hollow 16 closed with the cover 20, the annular top surface of the lid 10 is flush with the top face of the cover 20.

The cover 20 has a tab 22 projecting from the circumference thereof. The tab 22 is across a diameter of the cover 20 from the hinge 18. The lid 10 has a recess 27 in the periphery, adapted to receive the tab 22. The tab 22 helps facilitate the cover 20 opening operation. The cover 20 also has a pair of claws 24 on the circumference thereof, on either side of and adjacent to the tab 22, while the large-diameter side-surface of the hollow 16 has engagement holes 26 at the locations corresponding to the claws 24. Thus, the cover 20 is closed with the claws 24 engaged with the engagement holes 26, which keeps the cover 20 in the closed position.

The hollow 16 has a volume to hold some tobacco products 1 inside. The lid 10 can thus be used as a waste container to temporarily keep used tobacco products 1. In other words, the container case 4 can keep unused tobacco products 1 and used tobacco products 1, separately.

Also the bottom face of the lid 10 has a circular hollow 29. The hollow 29 has an inside diameter slightly greater than the outside diameter of the open top portion 7 to receive the open top portion 7 (see FIG. 11). Further, the ceiling 28, or upper interior surface of the hollow 29 serves as a pushing surface for pushing the tobacco products 1 down within the case body 6.

By the user removing the lid 10 from the container case 4, the open top portion 7 of the case body 6 is exposed, so that the user can remove a tobacco product 1 from the case body 6 through the open top portion 7. The tobacco product 1 removed is placed between the upper lip and gum of the user to allow tobacco active constituents to be extracted from tobacco particles of the tobacco product 1 into saliva. The user can thus enjoy the aroma of tobacco particles, while ingesting the tobacco active constituents via saliva.

The tobacco product 1 does not emit smoke in use. The user can thus use the tobacco product 1 anywhere. Incidentally, the user can lift the cover 20 from the hollow 16 of the lid 10 with his/her fingers on the tab 22 of the cover 20, to put the used tobacco product 1 in the hollow 16.

To promote extraction of the tobacco active constituents into saliva and absorption thereof into the user body, it is desirable that the tobacco mixture, and thus, the tobacco particles have a high moisture content. The moisture content of the tobacco particles is thus regulated to 15 to 50 weight %. The tobacco particles are desirably alkaline; the pH thereof is between 6.5 and 9.5.

Considering that the tobacco particles have a high moisture content, at least either the inner or the outer surface of the pouch 2 of the tobacco product 1 is partly coated with a water-repellent material. Specifically, the water-repellent material is applied to the inner or the outer surface of the pouch 2 so that the area coated with the water-repellent material accounts for one half or greater of the entire inner or outer surface of the pouch 2. Such application of the water-repellent material produces a water-repellent area on the pouch 2, which will be described below. The water-repellent area prevents permeation of water.

Specifically, water-repellent fluorine-based resin is a suitable water-repellent material. AsahiGuard (registered trademark) manufactured by Asahi Glass Co., Ltd. is an example of such water-repellent fluorine-based resin. Such water-repellent fluorine-based resin is commonly used to coat wrappers for food and other products containing oils and fats, such as confectionery, dairy products, cooked foods, fast foods and pet foods, and thus, safe when applied to the pouch 2 of the tobacco product 1 intended to be put in the mouth. The water-repellent material to be used is not restricted to the fluorine-based resin; materials having water-repellency, such as paraffin resin, silicon-based resin and epoxy resin, are usable.

The water-repellent material may contain an additive such as calcium carbonate or titanium dioxide. Such additive increases whiteness of the water-repellent material.

Specifically, as seen in FIG. 1, a first embodiment of tobacco product 1 has water-repellent areas 30 forming a checkered pattern. The water-repellent areas 30 may form an oblique stripe pattern or a dot pattern instead of the checkered pattern.

FIGS. 3 to 10 show second to ninth embodiments of tobacco product 1, respectively. Similarly to the first embodiment, these embodiments of tobacco product 1 are also of the pouch type.

Figure 3:
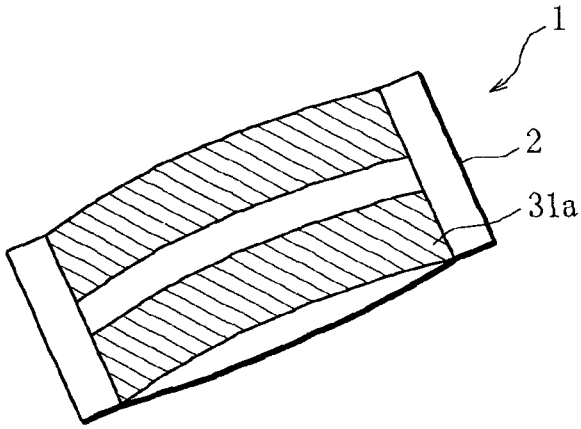
FIG. 3 is a schematic diagram showing a second embodiment of tobacco product.

The tobacco product 1 shown in FIG. 3 has a plurality of water-repellent areas 31*a* on the inner side of those parts of the non-woven fabric sheet which form the front and rear faces of the pouch 2. Specifically, either face of the pouch 2 has water-repellent areas 31*a* which extend in the direction of length of the pouch 2 with a space between each other in the direction of width of the pouch 2. The space is approximately half as wide as the water-repellent area 31*a*. In this case, the water-repellent areas 31*a* account for approximately 60% of the entire inner surface of the pouch 2.

Figure 4:
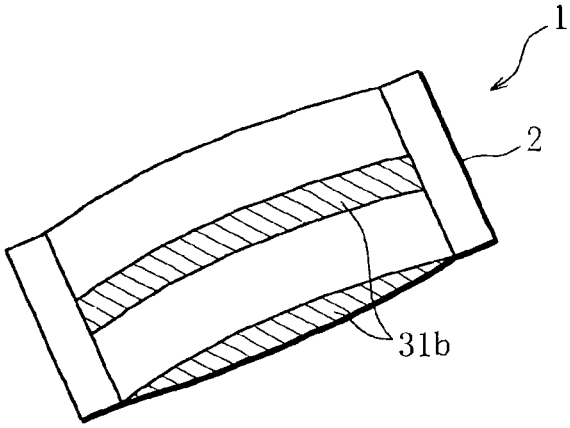
FIG. 4 is a schematic diagram showing a third embodiment of tobacco product.

The tobacco product 1 shown in FIG. 4 has a plurality of water-repellent areas 31*b* on the front face as well as the rear face of the pouch 2. The water-repellent areas 31*b* are similar to the aforementioned water-repellent areas 31*a*, but the space between the water-repellent areas 31*b* is approximately twice as wide as the water-repellent area 31*b*. In this case, the water-repellent areas 31*b* account for approximately 40% of the entire inner surface of the pouch 2.

Figure 5:
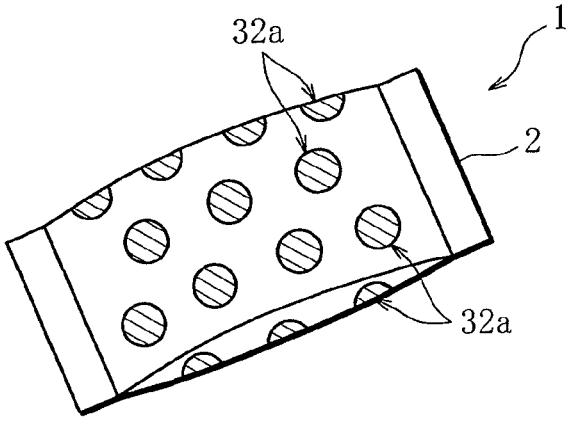
FIG. 5 is a schematic diagram showing a fourth embodiment of tobacco product.

The tobacco product 1 shown in FIG. 5 has circular water-repellent areas 32*b* distributed on the entire inner surface of the pouch 2. Specifically, the front and rear faces of the pouch 2 are each assigned seven circular water-repellent areas 32*a* and four semicircular water-repellent areas 32*a*, which means that eighteen water-repellent areas 32*a* in all are distributed on the entire inner surface of the pouch 2. In this case, the water-repellent areas 32*a* account for approximately 20.3% of the entire inner surface of the pouch 2.

Figure 6:
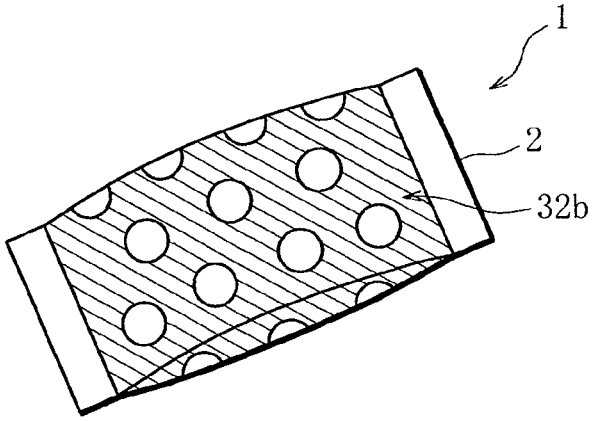
FIG. 6 is a schematic diagram showing a fifth embodiment of tobacco product.

In contrast to the pouch 2 shown in FIG. 5, the pouch 2 of the tobacco product 1 shown in FIG. 6 has a water-repellent area 32*b* corresponding to the area other than the water-repellent areas 32*a*. In this case, the water-repellent area 32*b* accounts for approximately 79.7% of the entire inner surface of the pouch 2.

Figure 7:
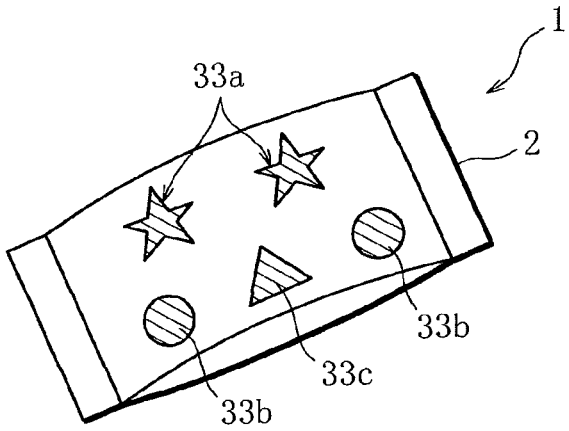
FIG. 7 is a schematic diagram showing a sixth embodiment of tobacco product.

The tobacco product 1 shown in FIG. 7 comprises a pouch 2 with two water-repellent areas 33*a*, two water-repellent areas 33*b* and one water-repellent area 33*c* on the front face as well as on the rear face, these water-repellent areas 33 being almost uniformly distributed. Specifically, the star-shaped water-repellent areas 33*a* are arranged along a longitudinal axis of the pouch 2, in one of the two longitudinal zones defined by the longitudinal axis of the pouch on the front and rear faces of the pouch 2.

Meanwhile, the circular and triangular water-repellent areas 33*b*, 33*c* are arranged in the other of the two longitudinal zones. Specifically, the water-repellent areas 33*b* are arranged along the longitudinal axis with the water-repellent area 33*c* between the areas 33*b*, or in other words, the water-repellent areas 33*b*, 33*c* are arranged alternately along the longitudinal axis.

Figure 8:
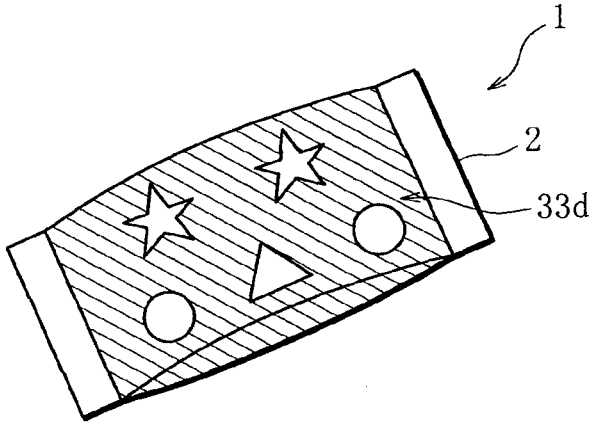
FIG. 8 is a schematic diagram showing a seventh embodiment of tobacco product.

The tobacco product 1 shown in FIG. 8 comprises a pouch 2 with a water-repellent area 33*d* on the front face as well as on the rear face. The water-repellent area 33*d* corresponds to the area other than the water-repellent areas 33*a*, 33*b*, 33*c* shown in FIG. 7.

Figure 9:
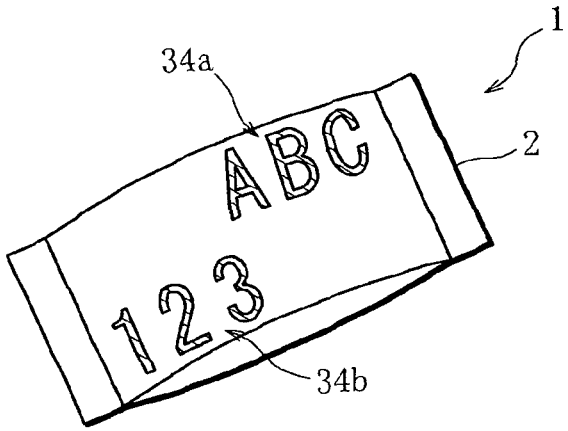
FIG. 9 is a schematic diagram showing an eighth embodiment of tobacco product.

The tobacco product 1 shown in FIG. 9 comprises a pouch 2 with water-repellent areas 34*a*, 34*b* on the front face as well as on the rear face. While the aforementioned water-repellent areas 33*a* to 33*c* are in the shape of a geometric figure, the water-repellent areas 34*a*, 34*b* are in the shape of a combination of letters or a combination of numerals. Specifically, the water-repellent area 34*a* is arranged in one of the two longitudinal zones on the front and rear faces of the pouch 2, and in the shape of a combination of phonograms such as letters of the alphabet or a combination of ideograms such as Chinese characters.

Meanwhile, the water-repellent area 34*b* is arranged in the other of the two longitudinal zones and in the shape of a combination of numerals in Arabic notation or other. The water-repellent areas 34*a*, 34*b* can thus give information such as the ingredients and the amount of the tobacco mixture included in the tobacco product 1, and the brand and the best-before date of the tobacco product 1.

Figure 10:
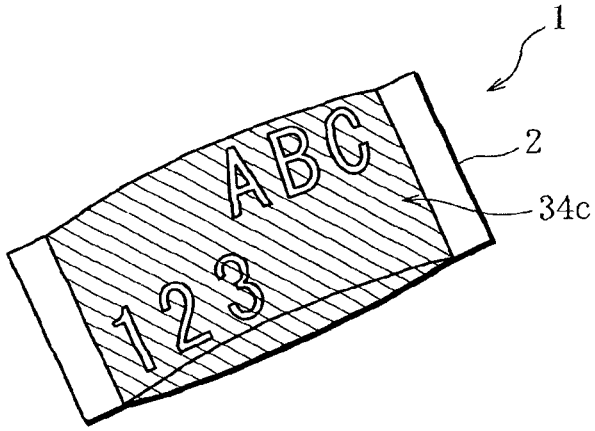
FIG. 10 is a schematic diagram showing a ninth embodiment of tobacco product.

The tobacco product 1 shown in FIG. 10 comprises a tobacco pouch 2 with a water-repellent area 34*c* on the front and rear faces. The water-repellent area 34*c* corresponds to the area other than the aforementioned water-repellent areas 34*a*, 34*b*. In this case, the area other than water-repellent area 34*c*, namely, areas corresponding to the aforementioned water-repellent areas 34*a*, 34*b* have the same informative function as the aforementioned water-repellent areas 34*a*, 34*b* have.

Figure 11:
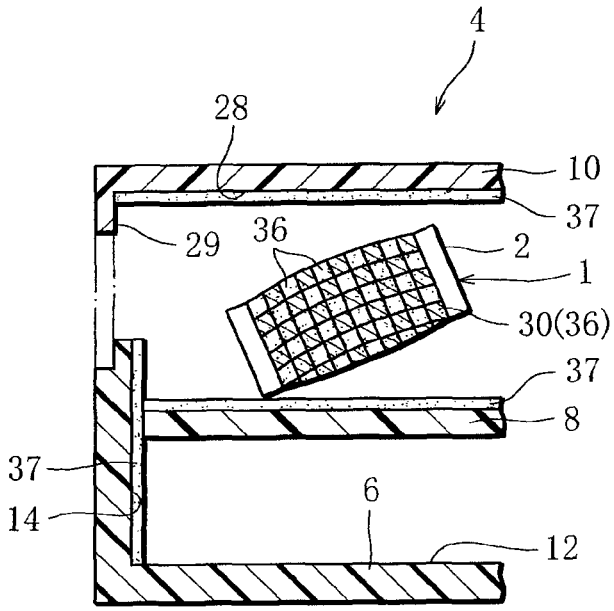
FIG. 11 is a diagram showing part of a cross-section of a container case provided with a layer of a food flavoring, together with a tobacco product containing a food flavoring.

Even though the pouch 2 has water-repellent areas as described above, there remains a possibility that water contained in the tobacco particles spreads to the outer surface of the pouch 2, where tobacco active constituents contained in tobacco particles also seeps with water. To compensate for such loss of tobacco active constituents, a food flavoring 36 may be deposited or applied to at least either the pouch 2-forming wrapper, namely, non-woven fabric sheet or the container case 6. Specifically, as shown in FIG. 11, the container case 6 has a flavoring layer 37, or layer of a food flavoring 36 formed inside in advance. The flavoring layer 37 is formed on at least one surface chosen from the inner wall surface 14 of the case body 6, the upper surface of the mat 8 and the ceiling 28 of the lid 28.

The food flavoring 36 used to form the flavoring layer 37 is a menthol liquid prepared by dissolving 1 weight % of menthol in alcohol. The menthol liquid is sprayed to coat at least one surface chosen from the inner wall surface 14 of the case body 6, the upper surface of the mat 8 and the ceiling 28 of the lid 28.

If a coupon is put in the container case 4, the flavoring layer 37 may be formed also on a surface of the coupon. When the food flavoring 36 is used, the tobacco product 1 desirably contains also a humectant such as glycerin or propylene glycol.

Menthol, mint, vanilla, apricot, tea, cacao, licorice and honey, which may be used alone or in combination as the food flavoring 36.

The solvent is not restricted to alcohol; usable solvents include water, glycerin and propylene glycol.

Since the tobacco particles 4 have an alkaline pH between 6.5 and 9.5 as mentioned above, the food flavoring 36 is desirably neutral or alkaline if it is deposited or applied to the pouch 2.

The food flavoring 36 used in this case may be glycerin which functions also as a humectant. Glycerin is deposited or applied to the pouch 2 only in the amount accounting for 1 weight % of the tobacco mixture.

The food flavoring 36 may be deposited or applied to the pouch 2 only in the aforementioned water-repellent areas. In this case, the water-repellent agent and the food flavoring 36 are mixed together, and the resulting mixture is deposited or applied to the inner or outer surface of the pouch 2 to form water-repellent areas. The food flavoring 36 may be applied or deposited on the pouch 2 in areas other than the water-repellent areas.

Next, the process of manufacturing the tobacco product 1 will be described.

Figure 12:
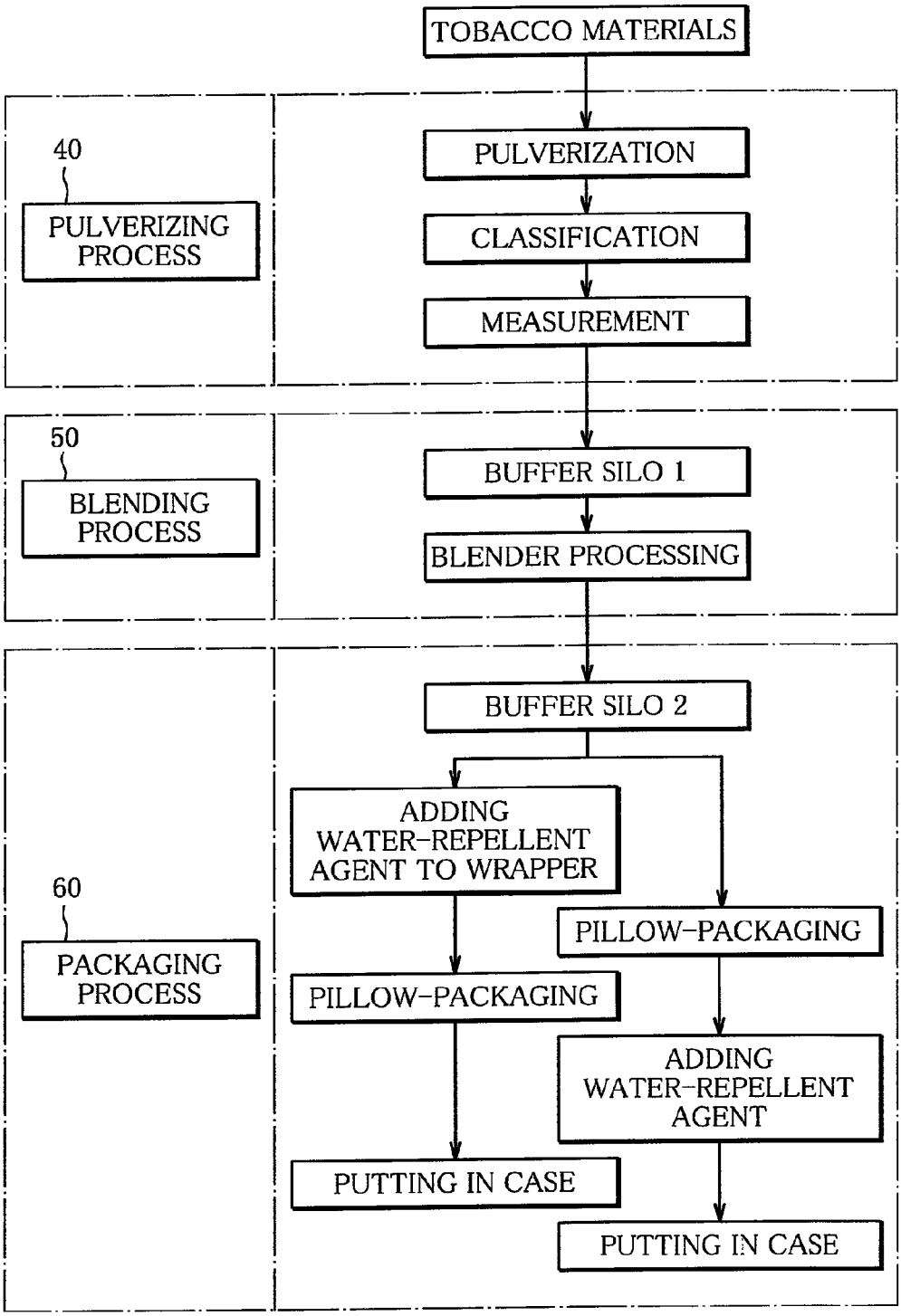
FIG. 12 is a block diagram showing the process of manufacturing the tobacco product.

FIG. 12 is a block diagram showing the process by which the tobacco product 1 is manufactured.

As seen in FIG. 12, the tobacco product 1 is manufactured by a pulverizing process 40, a blending process 50 and a packaging process 60.

First, in the pulverizing process 40, laminae and stems of domestic Burley tobacco are separately pulverized to 2 mm or less tobacco particles using a pulverizer. The resulting two types of tobacco particles are each put in a classifier to sort out tobacco particles with predetermined size. Then, the two types of tobacco particles, namely, lamina-derived and stem-derived tobacco particles are measured out in the proportion of 50 to 50 weight % and transferred to the blending process 50.

In the blending process 50, the measured-out two types of tobacco particles are moved to a buffer silo 1 to be stored therein for a predetermined period of time. After the predetermined period of storage in the buffer silo 1, the tobacco particles are heat-sterilized and cooled, and then subjected to a blender processing. By the blender processing, the two types of tobacco particles are mixed, and additives including a flavoring are added to them.

Specifically, in the blender processing, first, water is added to the tobacco particles so that the tobacco particles contain 25 weight % of moisture. Then, the tobacco particles are sterilized by being heated at 100° C. for 4 hours, and then cooled by circulating coolant water. During cooling, additives are added to the tobacco particles. Specifically, the additives include 10 weight % of potassium carbonate, 1 weight % of vitamin C, 5 weight % of a flavoring, and sodium chloride, where the percentage is relative to the tobacco particles.

The additives and the tobacco particles are mixed together to form a tobacco mixture containing the tobacco particles as a major ingredient. Then by adding water, the tobacco mixture is regulated to contain 50 weight % of moisture.

Then, the tobacco mixture is transferred from the blending process 50 to the packaging process 60. The tobacco particles in the tobacco mixtures have desirably a pH between 6.5 and 9.5.

The packaging process 60 uses a buffer silo 2. The tobacco mixture is stored in the buffer silo 2 for a predetermined period of time.

Besides the above-described tobacco mixture, a non-woven fabric sheet is prepared. The non-woven fabric sheet has water-repellent areas as described above, which are formed in advance by applying a water-repellent material, as mentioned above, to one side of the non-woven fabric sheet to form a thickness of 100 μm. The tobacco mixture supplied from the buffer silo 2 is pillow-packaged with the non-woven fabric sheet in amounts of 0.3 g. The tobacco product 1 with water-repellent areas arranged in any of the above-described patterns shown in FIGS. 1 and 3 to 10 is thus completed. The tobacco product 1 comprises the tobacco mixture and a pouch 2 enclosing the tobacco mixture 2, the pouch 2 having water-repellent areas on the inner surface. Specifically, the tobacco product 1 is in the shape of a rectangle measuring approximately 12.5 by 31 mm, with a thickness of approximately 2 mm. The pouch 2 has transverse seals at either end of its length, the transverse seals measuring approximately 3 mm wide. The water-repellent areas may be formed on the front and rear faces of the pouch 2 after the tobacco mixture is pillow-packaged with the non-woven fabric sheet, namely, after the pouch 2 is formed.

A predetermined number of manufactured tobacco products 1 are put in a container case 4 with a mat 8. Then the container case 4 is closed with a lid 10, by which a package containing the tobacco products 1 is completed.

If the pouch 2 should contain a food flavoring 36, glycerin is deposited or applied to the pouch 2 in the amount specified above, as the food flavoring 36. In place of glycerin, a menthol liquid may be sprayed to coat the pouch 2.

If the container case 4 should have a flavoring layer 37, or layer of a food flavoring 36, a menthol liquid as specified above is directly sprayed to coat at least one surface chosen from the inner wall surface 14 of the case body 6, the mat 8 and the ceiling 28 of the lid 10.

To verify the water repellent effect of the water-repellent agent, examples 1 to 5 of the tobacco product 1 with differing water-repellent areas, a tobacco product as comparative example 1 having no water-repellent area, and a tobacco product as comparative example 2 with a water-repellent area extending all over the inner surface of the pouch 2 were prepared. These tobacco products were each put in a bag with a vapor-deposited aluminum coating and kept in cold storage for a week. Then, the tobacco products were taken from the respective bags for comparative examination. Specifically, examples 1 to 5 of the tobacco product 1 had water-repellent areas accounting for 20.3, 40, 50, 60 and 79.7% of the entire inner surface of the pouch 2, respectively.

The comparative examination was conducted as to whether there was recognized seeping of tobacco active constituents to the outer surface of the pouch 2 of the tobacco product, and how evaluation examiners felt accompanying the absorption of tobacco active constituents in use of the tobacco product. The results are shown in table 1. As regards seeping of tobacco active constituents, examples 1 to 5 and comparative example 2 were examined, and as regards the feeling accompanying the absorption of tobacco active constituents, comparative example 1 and examples 1 to 5 were examined.

TABLE 1

| | Water-repellent areas [%] | Seeping of tobacco active constituents | Feeling accompanying absorption of tobacco active constituents | Satisfactory or not |
|---|---|---|---|---|
| Comparative example 1 | 0 | — | Good | X |
| Example 1 | 20.3 | Recognized | Good | Δ |
| Example 2 | 40 | A little | Good | ○ |
| Example 3 | 50 | A little | Good | ○ |
| Example 4 | 60 | A little | A little bland | Δ |
| Example 5 | 79.7 | Not recognized | Bland | Δ |
| Comparative example 2 | 100 | Not recognized | — | X |

As seen in table 1, in example 1 of the tobacco product with water-repellent areas accounting for 20.3%, seeping of tobacco active constituents to the outer surface of the pouch 2 was recognized. In examples 2 to 4 of the tobacco product with water-repellent areas accounting for 40, 50 and 60%, respectively, a slight degree of seeping of tobacco active constituents to the outer surface of the pouch 2 was recognized. By contrast, in example 5 and comparative example 2 of the tobacco product with water-repellent areas accounting for 79.7 and 100%, respectively, no seeping of tobacco active constituents to the outer surface of the pouch 2 was recognized.

As regards the feeling accompanying the absorption of tobacco active constituents, the evaluation examiners gave a good evaluation to comparative example 1 of the tobacco product with no water-repellent area and examples 1 to 3 of the tobacco product with water-repellent areas accounting for 20.3, 40 and 50%, respectively. By contrast, example 4 of the tobacco product with water-repellent areas accounting for 60% made the evaluation examiners feel that it was a little bland, as absorbing tobacco active constituents. Example 5 of the tobacco product with water-repellent areas accounting for 79.7% made the evaluation examiners feel that it was bland, as absorbing tobacco active constituents.

From this, it is concluded that the water-repellent areas provided on the tobacco product 1 can suppress seeping of tobacco active constituents, but that the water-repellent areas need to account for 40 to 50% of the entire inner surface of the pouch 2 to allow the user to have a feeling of full satisfaction accompanying absorption of tobacco active constituents.

Tobacco products 1 with water-repellent areas meeting this requirement can thus guarantee the user a feeling of satisfaction as mentioned above, and effectively suppress the penetration of water containing tobacco active constituents through the pouch 2, by virtue of the water-repellent areas, even though the tobacco particles have a moisture content as high as 50 weight %. Such tobacco products 1 do not have their appearance seriously spoiled, nor soil each other in the container case 4.

In the tobacco product 1 with the water-repellent areas 33*a* to 33*d* or 34*a* to 34*c*, water containing tobacco active constituents, permeating the area of the pouch 2 other than the water-repellent areas, makes the geometric figures or the combination of letters and the combination of numerals clearly emerge on the outer surface of the pouch 2. The tobacco product 1 has thus increased distinctiveness and improved appearance.

The present invention is not restricted to the described embodiments, which can be modified in various ways.

For example, the water-repellent area is not restricted to the types exemplified above; a desired type of water-repellent area may be provided, as long as it can suppress permeation of water and tobacco active constituents dissolved therein. The color of the water-repellent area is not restricted to white.

The geometry of the water-repellent area is not restricted to those exemplified above.

Further, the water-repellent area may be provided on either side of the nonwoven fabric sheet forming the pouch 2.

| Explanation of Reference Characters | |
|---|---|
| 1: | Oral tobacco product |
| 2: | Pouch |
| 4: | Container case |
| 6: | Case body |
| 7: | Open top portion |
| 8: | Mat |
| 10: | Lid |
| 12: | Bottom |
| 13: | Notch |
| 14: | Inner wall surface |
| 15: | Rest surface |
| 16: | Hollow |

-continued

| Explanation of Reference Characters | |
|---|---|
| 17: | Bottom |
| 18: | Hinge |
| 20: | Cover |
| 22: | Tab |
| 24: | Claw |
| 26: | Engagement hole |
| 27: | Recess |
| 28: | Ceiling |
| 29: | Hollow |
| 30: | Water-repellent area |
| 31a, 31b: | Water-repellent area |
| 32a, 32b: | Water-repellent area |
| 33a, 33b, 33c, 33d,: | Water-repellent area |
| 36: | Food Flavoring |
| 37: | Flavoring layer |
| 40: | Pulverizing process |
| 50: | Blending process |
| 60: | Packaging process |

The invention claimed is:

1. An oral tobacco product for causing a user to absorb active constituents of tobacco via saliva of the user when the oral tobacco product is put in the mouth of the user, the oral tobacco product comprising:

a tobacco mixture containing tobacco particles made from tobacco materials as a major ingredient, the tobacco particles having a moisture content;

a pouch made from a non-woven fabric sheet to enclose said tobacco mixture, the non-woven fabric sheet being water-permeable, and a water-repellent area formed on at least either an outer or an inner surface of the pouch to account for 20 to 60% of the entire outer or inner surface of the pouch, said water-repellent area preventing permeation of water coming out from the tobacco particles.

2. The oral tobacco product according to claim 1, wherein said water-repellent area is formed by applying a water-repellent material chosen from a group consisting of fluorine-based resin, paraffin resin, silicon-based resin and epoxy resin.

3. The oral tobacco product according to claim 2, wherein the water-repellent material contains an additive for making said water-repellent area appear in the same color as the non-woven fabric sheet.

4. The oral tobacco product according to claim 3, wherein the additive is calcium carbonate or titanium dioxide.

5. The oral tobacco product according to claim 1, wherein the tobacco particles have a pH between 6.5 and 9.5.

6. The oral tobacco product according to claim 1, wherein the tobacco particles have a moisture content between 15 and 50 weight %.

7. The oral tobacco product according to claim 1, wherein said water-repellent area accounts for 40 to 50% of the entire outer or inner surface of the pouch.

8. The oral tobacco product according to claim 1, wherein said water-repellent area is formed on the inner surface of the pouch.

9. The oral tobacco product according to claim 1, wherein said water-repellent area is visually distinctive.

10. The oral tobacco product according to claim 9, wherein said water-repellent area is in the shape of a geometric figure, a combination of letters or a combination of numerals.

11. The oral tobacco product according to claim 9, wherein said water-repellent area forms a checkered pattern.

12. The oral tobacco product according to claim 9, wherein said water-repellent area includes stripes extending along a longitudinal direction of the pouch and spaced in a circumferential direction of the pouch.

13. The oral tobacco product according to claim 12, wherein the pouch includes transverse seals at either end thereof, and the stripes extend between the ends of the pouch.

14. The oral tobacco product according to claim 1, wherein said water-repellent area includes a food flavoring.

* * * * *